US005224279A

United States Patent [19]

Agnew

[11] Patent Number: 5,224,279

[45] Date of Patent: Jul. 6, 1993

[54] ATHLETIC SHOE SOLE DESIGN AND CONSTRUCTION

[76] Inventor: James Agnew, 10851 Longford St., Lakeview Terrace, Calif. 91342

[21] Appl. No.: 716,844

[22] Filed: Jun. 17, 1991

[51] Int. Cl.[5] ..... A43B 13/12; A43C 15/00

[52] U.S. Cl. ..... 36/30 R; 36/31; 36/32 R; 36/59 C

[58] Field of Search ..... 36/32 R, 25 R, 114, 36/30 R, 59 R, 59 A, 59 C, 31; D2/320

[56] References Cited

U.S. PATENT DOCUMENTS

| | | | |
|---|---|---|---|
| D. 257,911 | 1/1981 | Ostberg | D2/320 |
| D. 266,371 | 10/1982 | Stubblefield . | |
| D. 267,366 | 12/1982 | Davis . | |
| D. 269,139 | 5/1983 | Stubblefield . | |
| D. 282,123 | 1/1986 | Davis . | |
| D. 321,589 | 11/1991 | Merk et al. | D2/320 |
| 1,111,437 | 9/1914 | Butterfield . | |
| 1,364,570 | 1/1921 | Martin . | |
| 1,736,576 | 11/1929 | Cable . | |
| 1,962,526 | 6/1934 | Riddell . | |
| 2,134,598 | 10/1938 | Burns . | |
| 2,424,463 | 7/1947 | Hogg . | |
| 2,887,794 | 5/1959 | Masera . | |
| 3,086,532 | 4/1963 | Mistarz | 36/32 R |
| 3,100,354 | 8/1963 | Lombard et al. . | |
| 4,083,125 | 4/1978 | Benseler et al. | 36/32 R |
| 4,096,649 | 6/1978 | Sauerwein . | |
| 4,259,792 | 4/1981 | Halberstadt . | |
| 4,274,211 | 6/1981 | Funck | 36/32 R |
| 4,319,412 | 3/1982 | Miller et al. | 36/29 |
| 4,327,503 | 5/1982 | Johnson | 36/32 R |
| 4,335,530 | 6/1982 | Stubblefield . | |
| 4,372,058 | 2/1983 | Stubblefield . | |
| 4,402,145 | 9/1983 | Dassler | 36/32 R |
| 4,449,307 | 5/1984 | Stubblefield . | |
| 4,481,727 | 11/1984 | Stubblefield . | |
| 4,494,320 | 1/1985 | Davis . | |
| 4,494,321 | 1/1985 | Lowler . | |
| 4,546,556 | 10/1985 | Stubblefield . | |
| 4,550,510 | 11/1985 | Stubblefield . | |
| 4,564,966 | 1/1986 | Chen | 36/32 R |
| 4,887,367 | 12/1989 | Mackness et al. | 36/28 |
| 5,079,856 | 1/1992 | Truelsen | 36/28 |

*Primary Examiner*—Steven N. Meyers
*Attorney, Agent, or Firm*—Thomas I. Rozsa; Dong Chen

[57] ABSTRACT

An athletic shoe sole comprising a midsole and an outsole. The midsole has a longitudinally concave shaped ball portion which is thinnest along a transverse metatarsal line, such that a longitudinal concavity is formed facing downwardly and crossing the entire width of the ball portion of the midsole. The outsole has a longitudinally convex shaped ball portion which is thickest along the transverse metatarsal line, such that a longitudinal convexity is formed facing upwardly and crossing the entire width of the ball portion of the outsole. The longitudinally convex shaped ball portion of the outsole has numerous conical shaped hollow tread members aligned in a plurality of transverse rows, and two longitudinally elongated edgewise non-hollow tread members each having a plurality of transverse grooves.

19 Claims, 5 Drawing Sheets (Section on line 8 – 8)

(Section on line 7 – 7)

(Section on line 10 – 10)

(Section on line 11 – 11)

ATHLETIC SHOE SOLE DESIGN AND CONSTRUCTION

BACKGROUND OF THE INVENTION

1. Field of the Invention

The present invention relates to the field of shoe sole design and construction. More particularly the present invention relates to the field of design and construction of the midsole and outsole of athletic shoes.

2. Description of the Prior Art

Shoe sole design and construction is an old art. Over the years numerous different types of shoe soles have been introduced and developed. The following prior art references are found to be relevant to the art.

1. U.S. Design Pat. No. Des. 266,371 issued to Stubblefield on Oct. 5, 1982 for "Shoe Sole" (hereafter "the '371 Design Patent").

2. U.S. Design Pat. No. Des. 267,366 issued to Davis on Dec. 28, 1982 for "Shoe Sole" (hereafter "the '366 Design Patent").

3. U.S. Design Pat. No. Des. 269,139 issued to Stubblefield on May 31, 1983 for "Athletic Shoe Outer Sole" (hereafter "the '139 Design Patent").

4. U.S. Design Pat. No. Des. 282,123 issued to Davis on Jan. 14, 1986 for "Shoe Outsole" (hereafter "the '123 Design Patent").

5. U.S. Pat. No. 1,111,437 issued to Butterfield on Sep. 22, 1914 for "Composite Boot And Shoe" (hereafter "the '437 Patent").

6. U.S. Pat. No. 1,364,570 issued to Martin on Jan. 4, 1921 for "Shoe Sole" (hereafter "the '570 Patent").

7. U.S. Pat. No. 1,736,576 issued to Cable on Nov. 19, 1929 for "Elastic Shoe Sole" (hereafter "the '576 Patent").

8. U.S. Pat. No. 1,962,526 issued to Riddell on Jun. 12, 1934 for "Basket Ball Shoe" (hereafter "the '526 Patent").

9. U.S. Pat. No. 2,134,598 issued to Burns on Oct. 25, 1938 for "Metatarsal Nonslip Sole" (hereafter "the '598 Patent").

10. U.S. Pat. No. 2,424,463 issued to Hogg on Jul. 22, 1947 for "Multiple Antiskid Ribbed Suction Sole For Shoes And Rubber Footwear" (hereafter "the '463 Patent").

11. U.S. Pat. No. 2,887,794 issued to Masera on May 26, 1959 for "Shoe Made of Thermo-Plastic Or Thermo-Setting Material Or the Like" (hereafter "the '794 Patent").

12. U.S. Pat. No. 3,100,354 issued to Lombard et al. on Aug. 13, 1963 for "Resilient Shoe Sole" (hereafter "the '354 Patent").

13. U.S. Pat. No. 4,096,649 issued to Saurwein on Jun. 27, 1978 for "Athletic Shoe Sole" (hereafter "the '649 Patent").

14. U.S. Pat. No. 4,259,792 issued to Halberstadt on Apr. 7, 1981 for "Article of Outer Footwear" (hereafter "the '792 Patent").

15. U.S. Pat. No. 4,335,530 issued to Stubblefield on Jun. 22, 1982 for "Shoe Sole Construction" (hereafter "the '530 Patent").

16. U.S. Pat. No. 4,372,058 issued to Stubblefield on Feb. 8, 1983 for "Shoe Sole Construction" (hereafter "the '058 Patent").

17. U.S. Pat. No. 4,449,307 issued to Stubblefield on May 22, 1984 for "Basketball Shoe Sole" (hereafter "the '307 Patent").

18. U.S. Pat. No. 4,481,727 issued to Stubblefield on Nov. 13, 1984 for "Shoe Sole Construction" (hereafter "the '727 Patent").

19. U.S. Pat. No. 4,494,320 issued to Davis on Jan. 22, 1985 for "Shoe Outsole" (hereafter "the '320 Patent").

20. U.S. Pat. No. 4,494,321 issued to Lawlor on Jan. 22, 1985 for Shock Resistant Shoe Sole" (hereafter "the '321 Patent").

21. U.S. Pat. No. 4,546,556 issued to Stubblefield on Oct. 15, 1985 for "Basketball Shoe Sole" (hereafter "the '556 Patent").

22. U.S. Pat. No. 4,550,510 issued to Stubblefield on Nov. 5, 1985 for "Basketball Shoe Sole" (hereafter "the '510 Patent").

23. U.S. Pat. No. 4,562,651 issued to Frederick et al. on Jan. 7, 1986 for "Sole with V-Oriented Flex Grooves" (hereafter "the '651 Patent").

24. U.S. Pat. No. 4,577,422 issued to Tanel on Mar. 25, 1986 for "Athletic Shoe With Improved Pivot Cleating" (hereafter "the '422 Patent").

25. U.S. Pat. No. 4,697,361 issued to Ganter et al. on Oct. 6, 1987 for "Base For An Article of Footwear" (hereafter "the '361 Patent").

26. U.S. Pat. No. 4,741,114 issued to Stubblefield on May 3, 1988 for "Shoe Sole Construction (hereafter "the '114 Patent").

27. International Publication published under Patent Corporation Treaty (PCT) No. WO 89/05105 (hereafter "the PCT Publication '105").

28. French Patent No. 2,500,278 (hereafter "the French Patent").

The '371 Design Patent (1982) discloses a shoe outsole design having a plurality of downwardly and outwardly inclined lugs or levers.

The '366 Design Patent (1982) discloses a shoe outsole design having the general appearance of a figure eight (8).

The '139Design Patent (1983) discloses a shoe outsole design having an outmost row of downwardly and outwardly inclined lugs and several inwardly spaced additional rows of lugs of lesser vertical dimensions.

The '123 Design Patent (1986) discloses a shoe outsole design having the general appearance of a figure eight (8), which is similar to the one shown in the '366 Design Patent (the portion of the term of the '123 Design Patent subsequent to the expiration date of the '366 Patent has been disclaimed). There is a crosshatched pattern of grooves cut into the bottom surface of the outsole of the '123 Design Patent.

The '437 Patent (1914) discloses a composite boot or shoe outsole 14 having a tread bottom surface. The ball portion and the heel portion of the tread bottom surface has elongated diamond forms d, and the marginal portion of the tread bottom surface is notched or scored with short, parallel transverse channels c.

The '570 Patent (1921) discloses a shoe sole 1 having a raised portion 5 at the ball portion of its bottom surface. The raised portion 5 is made concave to form a recess 6. A raised extension 8 is formed upon the raised portion 5 and extends rearwardly to the instep portion 3 terminating in an abrupt shoulder 9 which is adapted to contact with an ordinary shoe heel.

The '576 Patent (1929) discloses an elastic shoe sole having a top side and a bottom side. The ball portion of the top side is bowed into a convex form 11, and the ball portion of the bottom side is recessed into a concave form 13 surrounded by a circular boss 12. The ball portion of the bottom side further has two longitudinal ribs 16 surrounding the circular boss 12. The toe portion of the bottom side has a transversely elongated and forwardly thinned boss 14 and a plurality of transverse ribs 15.

The '526 Patent (1934) discloses a basketball shoe having a sole and an upper 2 independently sewn onto an intermediately disposed welt 3. The bottom surface of the sole 1 is dished at 14 to form a marginal bearing ridge 15, where the dishing is deepest at its heel portion 16, shank portion 17 and toe portion 18.

The '598 Patent (1938) discloses a metatarsal nonslip shoe sole 1 having a longitudinally extended substantially oval shaped concavity or depression 5 at its bottom surface.

The '463 Patent (1947) discloses a shoe or rubber footwear sole 5 having a plurality of small round molded suction cups such as suction cups 9, 14, 19 and 20, and skid resisting areas surrounding each suction cup. Each skid resisting area is formed with a group of molded skid resisting ribs, such as intersecting groups 11 and 12 at area 10 surrounding suction cup 9, and groups 15, 16 and 17 at areas surrounding suction cups 14, 19 and 20 respectively.

The '794 Patent (1959) discloses a thermoplastic or thermo-setting high-heel shoe sole A having a central depression 1 at the ball portion of its bottom surface. The central depression 1 is provided with a central projection 7 and cross-ribs 8, and surrounded by a pair of parallel border ribs 2. A resilient member 6' may be inserted into the continuous channel 3 formed between the two parallel border ribs 2.

The '354 Patent (1963) discloses a resilient shoe sole 11 having two oppositely disposed longitudinal outer rims 12 and 13 at its bottom. Defined by the two longitudinal outer rims 12 and 13 there is a longitudinal groove extending through the entire length of the ball and instep portions of the sole 11.

The '649 Patent (1978) discloses an athletic shoe sole 10 having a multiplicity of downwardly extending flanges including an outer peripheral flange 22, a heel section flange 24, a toe section flange 26 and a reinforcing transverse flange 30. The multiplicity of flanges define a multiplicity of recesses which are upwardly concave, including a toe section recess defined by the toe section flange 24 which is upwardly concave in both the longitudinal and lateral directions of the sole 10.

The '792 Patent (1981) discloses a running shoe 10 having a shoe base 12 and a shoe upper 14. The shoe base 12 has a multi-layer heel part integral with a sole part. The bottommost layer 22 of the heel part has two oppositely disposed and outwardly projected longitudinal fins 28 and 30 forming a longitudinal recess at the bottom of the heel part.

The '530 Patent (1982) discloses a shoe sole 12 having a midsole 16 and an outsole 18. The outsole 18 has a large opening 26 at its ball portion and a small opening 28 at its heel portion for allowing a front protruding portion 30 and rear protruding portion 32 of the midsole 16 to extend through respectively. The lower surface of the front protruding portion 30 of the midsole 16 has a longitudinal concavity 34 as well as a transverse concavity 36.

The '058 Patent (1983) discloses an athletic shoe outsole 6 having at its bottom surface an outmost row of downwardly and outwardly inclined lugs 7, and two inwardly spaced additional rows of lugs 22 and 23 of lesser vertical dimensions which are similar to the ones shown in the '139 Design Patent. The rows of lugs define a longitudinal and transverse concavity at the bottom surface of the outsole 6.

The '307 Patent (1984) discloses a basketball shoe outsole 10 having an inner surface 17 and an outer surface 13. In the central portion of the inner surface 17 there is a pedestal structure 100. In the rear foot portion 25 of the bottom surface 13 there are two outer rows of downwardly and outwardly inclined levers 14–40 adjacent respectively to the two opposite side edges of the bottom surface 13.

The '727 Patent (1984) discloses a shoe sole 12 which is similar to the one disclosed in the '530 Patent (the application of the '727 Patent is a division of the application of the '530 Patent). The shoe sole 12 has a midsole 16 and an outsole 18. At the bottom surface of the outsole 18 there are a plurality of downwardly and outwardly inclined lugs or levers 20 which are similar to the ones shown in the '371 Design Patent.

The '320 Patent (1985) discloses a shoe outsole 10 having the general appearance of a figure eight (8) with a crosshatched pattern of grooves 40 cut into the bottom surface 19 of the outsole 10, which is similar to the one shown in the '123 Design Patent. The bottom surface 19 of the outsole 10 has two generally oval shaped depressed regions 21 and 25 formed in the heel and toe regions 14 and 16 respectively.

The '321 Patent (1985) discloses a shock resistant shoe sole 12 having three inverted cup shaped cavities 20, 22 and 24 respectively located under the three natural contact points 60, 62 and 64 of a human foot 54. Cavity 20 is located directly under heel bone 60, cavity 22 is located directly under the first metatarsal 62, and cavity 24 is located directly under the fifth metatarsal 64.

The '556 Patent (1985) discloses a basketball shoe outsole 10 which is similar to the one disclosed in the '307 patent (the application of the '556 Patent is a continuation of the application of the '307 Patent, and the portion of the term of the '556 Patent subsequent to the expiration date of the '307 Patent has been disclaimed).

The '510 Patent (1985) discloses a basketball shoe outsole 10 which is similar to the one disclosed in the '307 Patent (the application of the '510 Patent is a division of the application of the '307 Patent). The outsole 10 has an inner surface 17 and an outer surface 13. In the forefoot portion of the outer surface 13 there is formed an oval herringbone tread surface 62 which has a plurality of grooves 64 and ridges 66. In the area under the head of the ball of the big toe of a wearer's foot there is a pivot stud 70 in the form of a concave cup and surrounded by concentric semi-circular grooves 68 which are an extension of grooves 64.

The '651 Patent (1986) discloses a shoe sole 14 having a midsole layer 18 and an outsole layer 20. At the bottom surface of the outsole layer 20 there are a plurality of cleats 24 and two straight grooves 30 an 32. The first groove 30 is aligned and coextensive with a first line extending substantially parallel to a medial metatarsal-phalanges line which extends between the first and second metatarsal-phalanges joints. The second groove 32 is aligned and coextensive with a second line extending substantially parallel to a lateral metatarsal-phalanges line which extends along the second through fifth metatarsal-phalanges joints. The first and the second grooves 30 and 32 join one another at the medial edge of the sole 14 to form a V-shaped configuration.

The '422 Patent (1986) discloses a shoe sole 14 for athletic field sports shoes. The sole 14 has a circular cleat 26 and a concentric standard tapered cleat 38 at the ball portion 22 and toe portion 24 of the sole 14, and a plurality of standard tapered cleats 36 at the heel portion 18 of the sole 14.

The '361 Patent (1987) discloses a shoe sole 1 having a multiplicity of recesses with different depths at its lower surface 2. The multiplicity of recesses includes a deep recess 6 below the big toe 13 of a foot 8, a shallow recess 7 below one or more of the small toes 14, a transverse recess 5 located below the ball portion 12 of the foot 8, an elongated recess 4 located at the instep portion 18, and a deep recess 3 below the heel 9 of the foot 8.

The '114 Patent (1988) discloses an athletic shoe sale 2 which is similar to the one disclosed in the '058 Patent. The athletic sole has a modified midsole 36 and an outsole 25. The transverse cross-section of the heel portion of the midsole 36 has a generally trapezoidal configuration, where the lower surface 39 of the midsole 36 has a transverse concavity. With rows 38, 40 and 41 of the downwardly and outwardly inclined lugs at the bottom surface of the outsole 25, the combination supports the athletic shoe construction in a cantilevered fashion.

The PCT Publication '105 (1989) discloses a shoe sole 1 having a midsole and an outsole. The outsole has an opening at its heel portion for allowing a projection 2 to extend downwardly through the opening.

The French Patent (1982) discloses a shoe sole having an upper surface and a lower surface. The lower surface of the sole has a large concavity 12 at its ball portion 11 and a small concavity 8 at its heel portion 7.

There are some well established general requirements for shoe sole design and construction. The shoe sole must: (a) provide overall comfort to the wearer's foot; (b) maintain adequate cushioning to the wearer's foot bones; (c) provide adequate protection from slippage; (d) have durable wearing life; (e) be easy to manufacture; and (f) be inexpensive to manufacture. As demonstrated by the prior art references, an effective way to fulfill these requirements is to modify the configuration and structure of a shoe sole.

Today a typical athletic shoe sole includes an insole, a midsole and an outsole. The insole contacts a wearer's foot, the outsole contacts the ground, and the midsole is sandwiched in between. Usually the insole is made of soft materials, the midsole is made of resilient material, and the outsole is made of hard materials.

As shown in FIG. 1, a human foot 10 can be divided into four major portions: a toe portion 12, a ball portion 14, an instep portion 16 and a heel portion 18. Accordingly, the insole, midsole and outsole portions each have four major portions: the toe portion, the ball portion, the instep portion and the heel portion, each respectively located below the corresponding portions of the human foot. The forces exerted on the human foot are most concentrated at its ball portion and heel portion.

In order to provide overall comfort and adequate cushioning to a wearer's foot, many prior art references have focused on the modification of the bottom surface of the outsole. One approach is to have some recesses or concavities at several locations, most commonly the ball portion and the heel portion. This approach can be found in many prior art references such as the '463 Patent, the '649 Patent, the '320 Patent, the '321 Patent, the '361 Patent and the French Patent. Another approach is to have some patterned projections or convexities at the bottom surface of the outsole. This approach can also be found in many prior art references such as the '058 Patent, the '307 Patent, the '727 Patent and the '422 Patent.

In addition to the general requirements, there are several more critical requirements for athletic shoe sole design and construction. These more critical requirements include: (a) high impact absorbability; (b) superb stability; and (c) maximum flexibility. These extra requirements are particularly important for basketball shoe soles. This is primarily due to the fact that basketball players' feet experience tremendous impact during running, jumping and landing which is much greater than the impact of normal standing, walking or jogging. Additionally, basketball players' feet are more likely to suffer ankle twists and similar injuries and basketball players' feet substantially elongate in the jumping position.

Several prior art references are directly related to basketball shoe soles. One way to improve impact absorption and avoid ankle injuries is to construct the outsole of a basketball shoe with so-called "cantilevered construction", which is disclosed in prior art references such as the '307 Patent, the '556 Patent and the '510 Patent. The cantilevered construction has two oppositely disposed rows of downwardly and outwardly inclined lugs constructed as part of the outsole to provide more cushioning to a wearer's foot. The cantilevered construction is further designed to provide more support along the inboard and outboard edges of the outsole, so the wearer's foot is properly centered. However, the cantilevered construction of these basketball shoe outsoles is mainly located in the rear foot area of the wearer's foot, whereas in the jumping position, a basketball player's foot is bent such that most of the force is exerted on the forefoot area. Additionally, when the basketball player lands on his forefoot, he is very likely to land off the center and injure his ankle. Therefore it is desirable to substantially improve the cushioning and ankle twist protection to the forefoot area.

There is an important factor which has not been recognized by any prior art references discussed above. This important factor is that a basketball player's foot elongates substantially in the bending position. Referring to FIG. 1, in the normal standing position or full stepping position, the total length of the human foot 10 is the sum of two segments AB and BD, where BD is the straight distance BC'D between points B and D. However, in the jumping up or landing down position, the human foot 10 is bent as shown in FIG. 2. In the maximum bending position shown in FIG. 2, the total length of the human foot 10 is the sum of three segment AB, BC and CD. Since the instep portion 16 of the human foot 10 is now fully stretched, the actual length BCD from point B to point D is longer than the direct straight distance BC'D between points B and D shown in FIG. 1. This factor is more clearly illustrated in FIG. 3, where the length of the arched shaped curve BCD is definitely longer than the length of the straight line BC'D. It is clear that the basketball player's foot actually elongates when it is bent for jumping up or landing down on his forefoot. Unfortunately, the prior art basketball shoe soles will not elongate with the basketball player's foot. In addition, most of the prior art basketball shoe soles include a midsole which generally has equal thickness at its ball portion. This prevents a shoe sole from following the bending of the ball portion of a foot. These disadvantages intensify the fatigue of basketball players' feet.

SUMMARY OF THE PRESENT INVENTION

The present invention is a novel athletic shoe sole design and construction.

It is known that there are some critical requirements for basketball shoe sole design and construction, including: (a) high impact absorbability; (b) superb stability; and (c) maximum flexibility. To improve the impact absorbability, many prior art basketball shoe soles utilize thickened midsoles and some of them utilize rows of lugs at the bottom surfaces of the outsoles. To further improve the centering stability, some prior art basketball shoe soles utilize oppositely disposed longitudinal rows of spaced apart lugs.

It has been discovered, according to the present invention, that if the resilient midsole of an athletic shoe sole such as a basketball shoe sole has a substantially concave shaped ball portion where the concavity is across the whole width of the ball portion of the midsole, then the midsole is substantially elongatable corresponding to the elongation of a basketball player's foot.

It has also been discovered, according to the present invention, that if the ball portion of the outsole of the basketball shoe sole is filled with a multiplicity of tread members, then the concave shaped ball portion of the flexible midsole of the basketball shoe sole can be adequately supported.

It has further been discovered, according to the present invention, that if the multiplicity of tread members of the ball portion of the outsole of the basketball shoe sole is aligned respectively in a plurality of transverse rows, then the outsole of the basketball shoe sole can easily bend with the elongatable midsole of the basketball shoe sole.

It has additionally been discovered, according to the present invention, that if the multiplicity of tread members of the outsole of the basketball shoe sole are generally conical shaped, then the tread members can more evenly distribute the impact upon them through their circular bases formed from the conical shape.

It has also been discovered, according to the present invention, that if the multiplicity of tread members of the ball portion of the outsole of the basketball shoe sole has different vertical dimensions, then the tapered tips can be aligned with the rest of the portions of the outsole of the basketball shoe sole.

It has further been discovered, according to the present invention, that if each of the multiplicity of tread members of the outsole of the basketball shoe sole has a hollow chamber, then the tread members can collapsibly absorb extreme impact.

It has additionally been discovered, according to the present invention, that if the outer tread members adjacent to the opposite edges of the outsole of the basketball shoe sole are block shaped and made harder than the inner tread members adjacent to the center of the ball portion of the outsole of the basketball shoe sole, then the basketball shoe sole will provide support to balance the basketball player's foot and further prevent ankle injuries.

It is therefore an object of the present invention to provide a basketball shoe sole having a resilient midsole which has a substantially concave shaped ball portion where the concavity is across the whole width of the ball portion of the midsole, so that the midsole of the basketball shoe sole is substantially elongatable corresponding to the elongation of a basketball player's foot.

It is also an object of the present invention to provide a basketball shoe sole, wherein the ball portion of the outsole of the basketball shoe sole is filled with a multiplicity of tread members, so that the concave shaped ball portion of the flexible midsole of the basketball shoe sole can be adequately supported.

It is a further object of the present invention to provide a basketball shoe sole, wherein the multiplicity of tread members of the ball portion of the outsole of the basketball shoe sole are aligned respectively in a plurality of transverse rows, so that the outsole of the basketball shoe sole can easily bend with the elongatable midsole of the basketball shoe sole.

It is an additional object of the present invention to provide a basketball shoe sole, wherein the multiplicity of tread members of the outsole of the basketball shoe sole is generally conical shaped so that the tread members can more evenly distribute the impact upon them through their circular bases.

It is also an object of the present invention to provide a basketball shoe sole, wherein the multiplicity of tread members of the ball portion of the outsole of the basketball shoe sole has different vertical dimensions so the tapered tips can be aligned with the rest of the portions of the outsole of the basketball shoe sole.

It is a further object of the present invention to provide a basketball shoe sole, wherein each of the multiplicity of tread members of the outsole of the basketball shoe sole has a hollow chamber, so the tread members can collapsibly absorb extreme impact.

It is an additional object of the present invention to provide a basketball shoe sole, wherein the outer tread members adjacent to the opposite edges of the outsole of the basketball shoe sole are block shaped and made harder then the inner tread members adjacent to the center of the ball portion of the outsole of the basketball shoe sole, so that the basketball shoe sole will provide support to balance the basketball player's foot and further prevent ankle injuries.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENT

Figure 8:
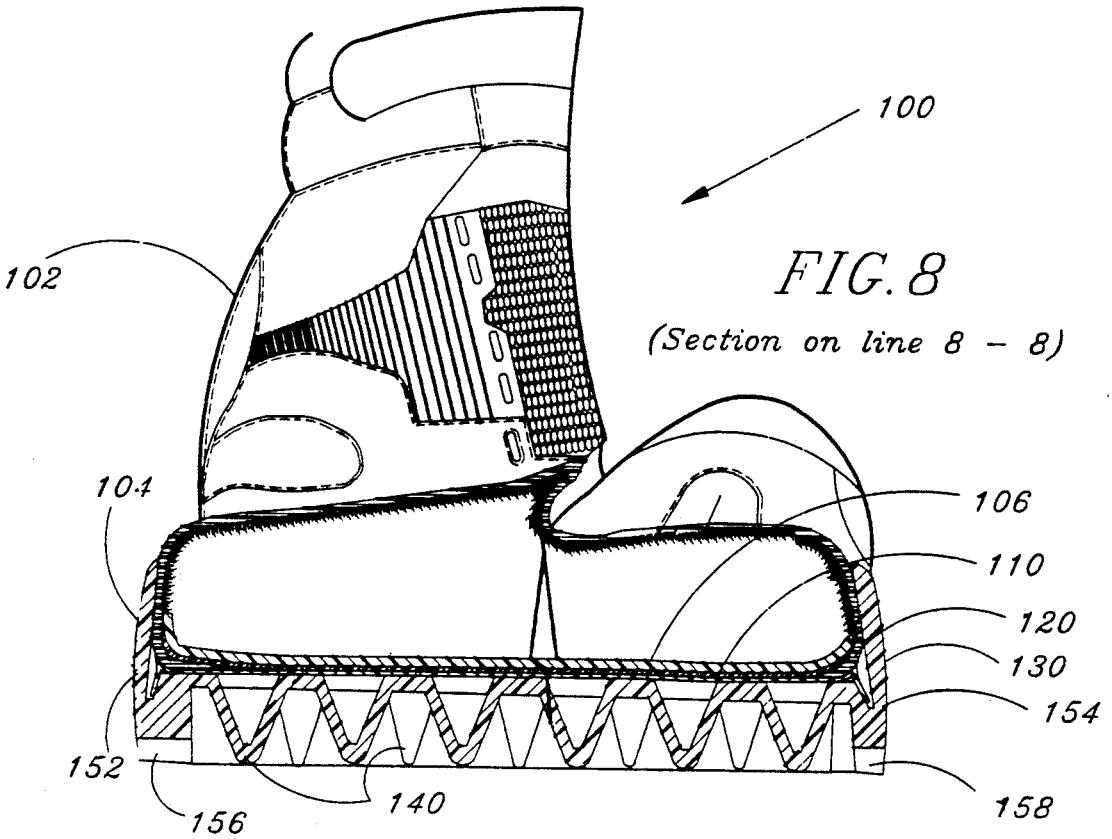
FIG. 8 is a transverse cross-sectional view of an athletic shoe incorporating the present invention basketball shoe sole taken along line 8—8 of FIG. 6.
Figure 1:
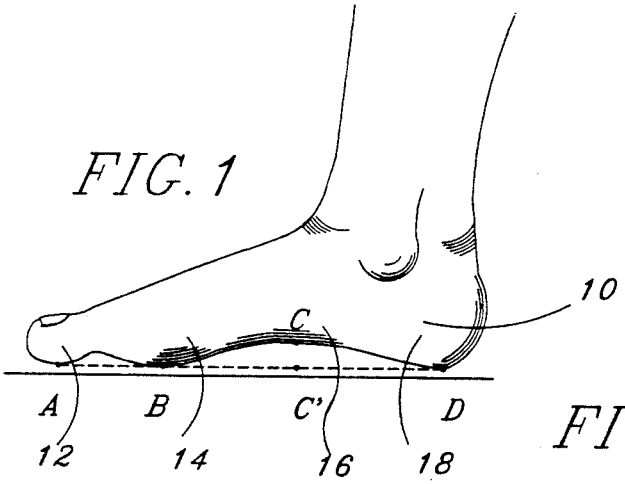
FIG. 1 is a side view of a human foot in the standing position.
Figure 2:
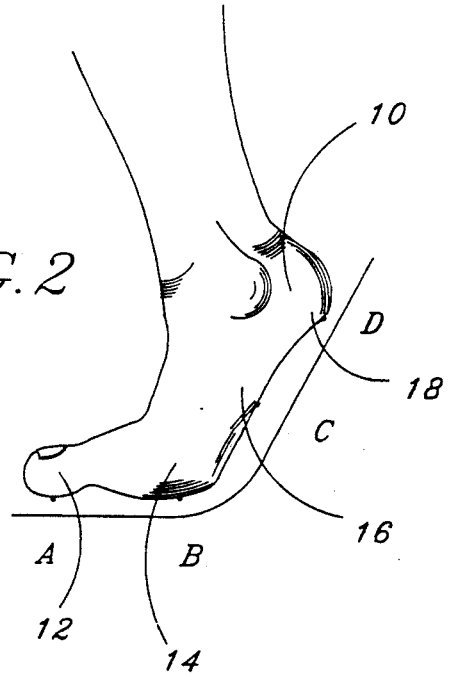
FIG. 2 is a side view of a human foot in the bending position.
Figure 3:
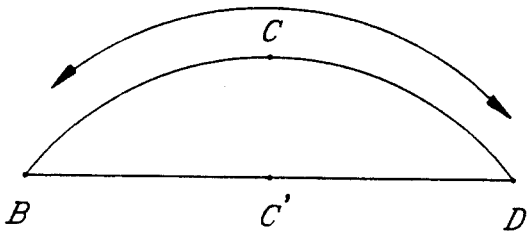
FIG. 3 is a representation showing the increased foot length which is achieved when a human foot is in the bending position of FIG. 2.
Figure 4:
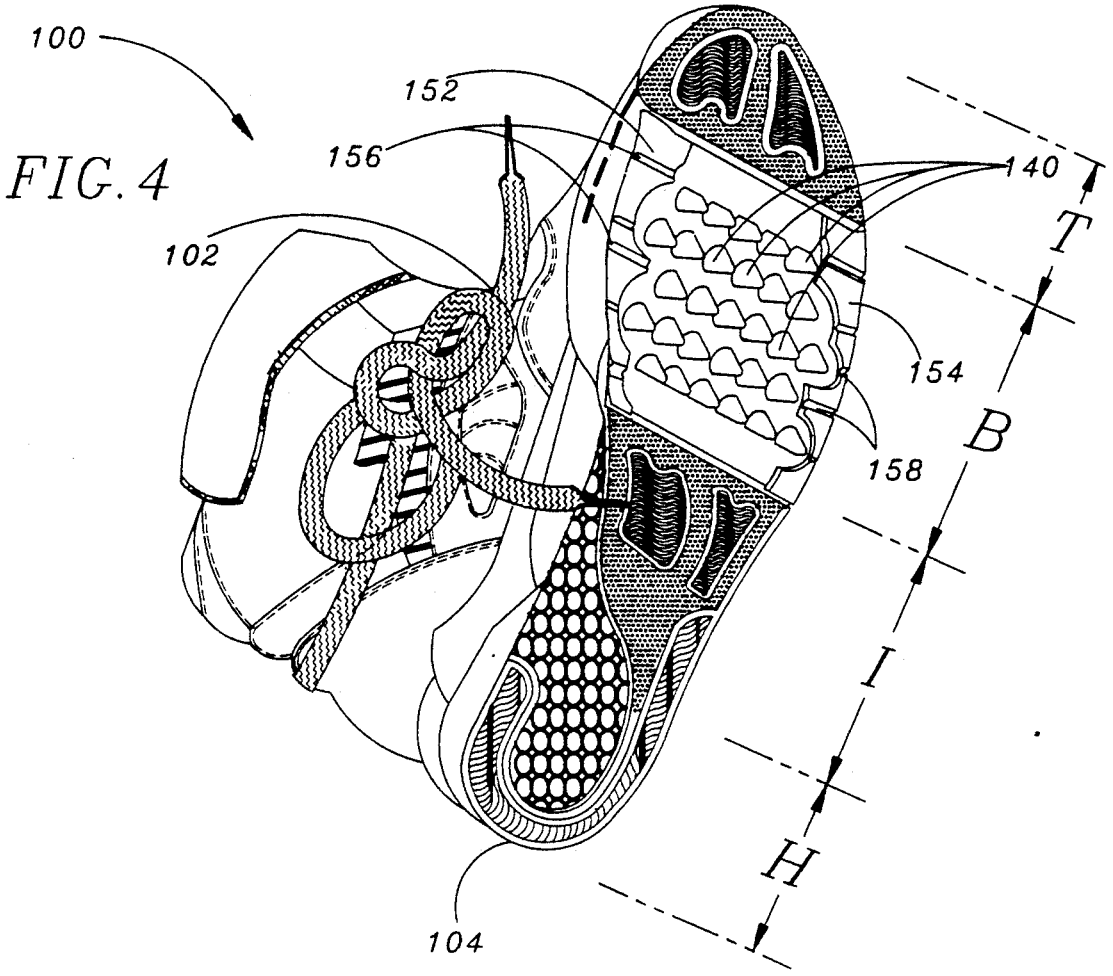
FIG. 4 is a perspective view of an athletic shoe incorporating the present invention athletic shoe sole.
Figure 5:
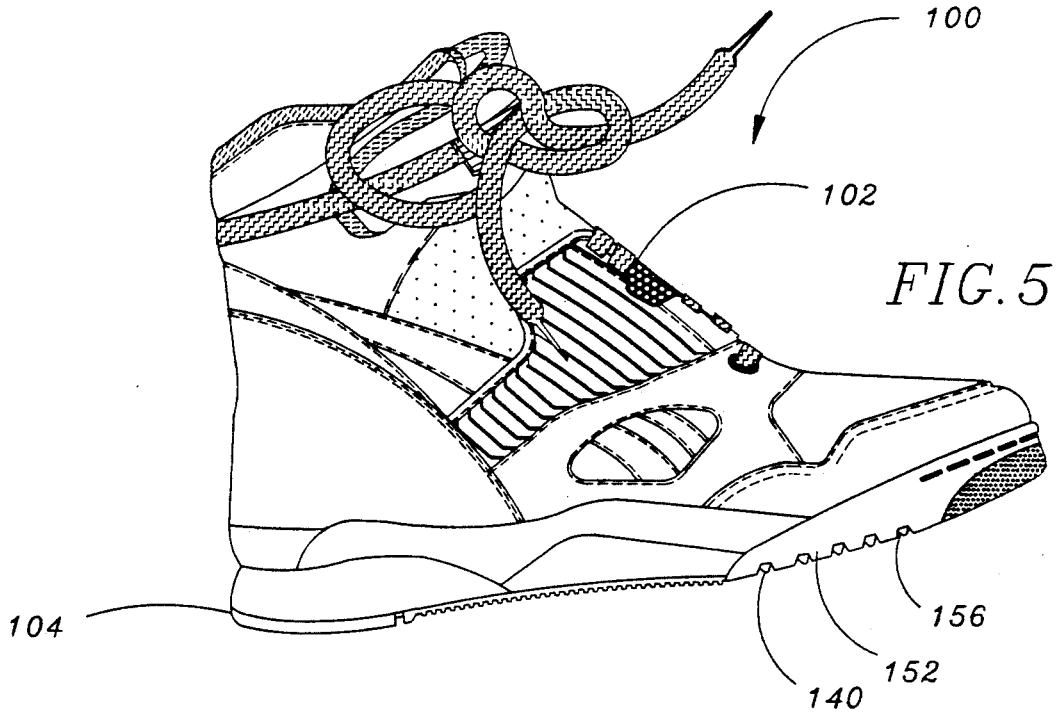
FIG. 5 is a side view of an athletic shoe incorporating the present invention athletic shoe sole.
Figure 6:
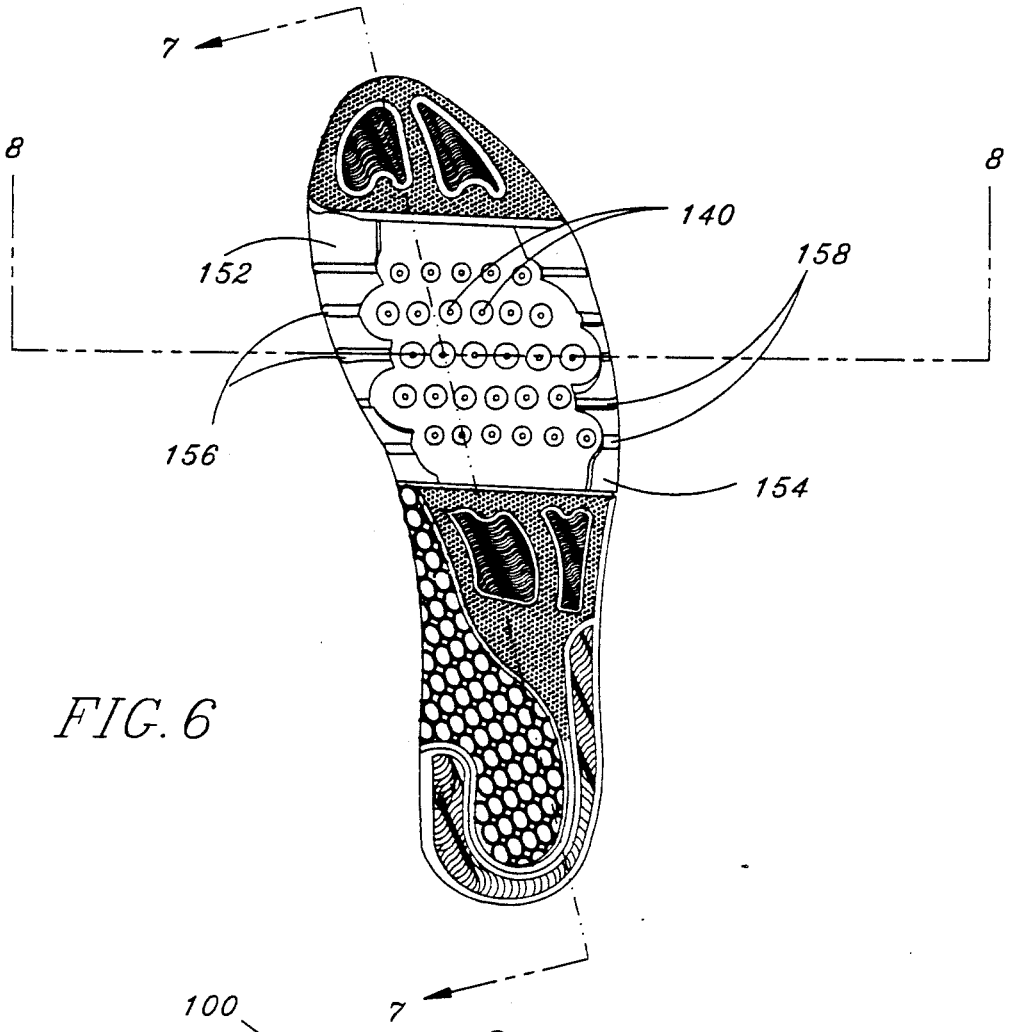
FIG. 6 is a bottom view of an athletic shoe incorporating the present invention athletic shoe sole.
Figure 7:
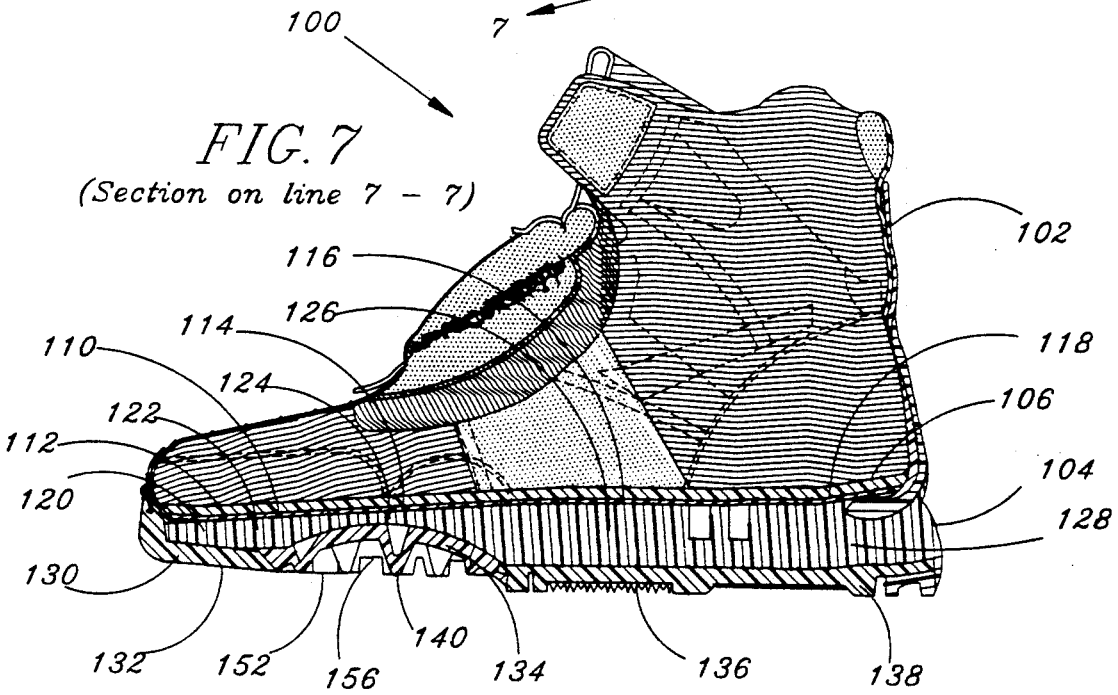
FIG. 7 is a longitudinal cross-sectional view of an athletic shoe incorporating the present invention athletic shoe sole taken along line 7—7 of FIG. 6.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIGS. 4–8, there is shown at 100 a preferred embodiment of an athletic shoe embodying the present invention athletic shoe sole. An athletic shoe such as basketball shoe 100 has an upper 102 and a sole 104. Sole 104 comprises an insole 110, a midsole 120 and an outsole 130. When a basketball player wears basketball shoe 100, there is usually a resilient cushioning pad 106 placed between the basketball player's foot and the insole 110. According to the structure of the basketball player's foot, the sole 104 can be divided into four portions: a toe portion "T", a ball portion "B", an instep portion "I" and a heel portion "H". Each portion is directly under the corresponding portion of the basketball player's foot. Accordingly, the insole 110 has a toe portion 112, a ball portion 114, an instep portion 116 and a heel portion 118; the midsole 120 has a toe portion 122, a ball portion 124, an instep portion 126 and a heel portion 128; and the outsole 130 has a toe portion 132, a ball portion 134, an instep portion 136 and a heel portion 138. The toe portions 112, 122 and 132 are vertically aligned and constitute the toe portion "T" of the basketball shoe sole 104; the ball portions 114, 124 and 134 are vertically aligned and constitute the ball portion "B" of the basketball shoe sole 104; the instep portions 116, 126 and 136 are vertically aligned and constitute the instep portion "I" of the basketball shoe sole 104; and the heel portions 118, 128 and 138 are vertically aligned and constitute the heel portion "H" of the basketball shoe sole 104.

The first novel feature of the present invention basketball shoe sole 104 is that the ball portion 124 of the midsole 120 is longitudinally concave shaped which is thinnest along a transverse line, which is in turn aligned with the metatarsal line of the basketball player's foot, such that a longitudinal concavity is formed facing downwardly and crossing the entire width of the ball portion 124 of the midsole 120. Therefore, when the basketball player's foot is bending, the ball portion 124 of the midsole 120 is able to be bent to its maximum, since when its is bent, the length of the ball portion 124 can extend to the length of its arch shaped bottom curve.

The second novel feature of the present invention basketball shoe sole 104 is that the ball portion 134 of the outsole 130 is longitudinally convex shaped which is thickest along a transverse line which in turn is also aligned with the metatarsal line of the basketball player's foot, such that a longitudinal convexity is formed facing upwardly and crossing the entire width of the ball portion 134 of the outsole 130. Therefore, the concavity of the ball portion 124 of the midsole 120 is fully supported by the convexity of the ball portion 134 of the outsole 130.

The third novel feature of the present invention basketball shoe sole 104 is that the ball portion 134 of the outsole 130 has a unique structure to not only fully support the ball portion 124 of the midsole 120, but also accommodate the bending flexibility of the ball portion 124 of the midsole 120. This unique structure is a multiplicity of conical shaped hollow tread members 140 aligned in a plurality of transverse rows. Each conical shaped hollow tread member has a tapered tip and a circular base. Since each tread member 140 is hollow inside, it is collapsible when a high impact force is exert on its tapered tip to thereby absorb the impact. Further, the remaining impact force is equally distributed through its circular base to the sole structure. The vertical dimensions of the conical shaped hollow tread members 140 are different, such that the outsole 130 has a generally flat bottom surface. However, the vertical dimensions of the respective ones of the of conical shaped hollow tread members 140 aligned in a respective transverse row are the same. The vertical dimensions of the conical shaped hollow tread members 140 aligned in the middle transverse row, which in turn is aligned with the thinnest portion of the ball portion 124 of the midsole 120, are the largest; the vertical dimensions of the conical shaped hollow tread members 140 aligned in the far front and far rear transverse rows, which in turn are close to the toe portion 122 and the instep portion 126 of the midsole 120 respectively, are the smallest. In addition, the conical shaped hollow tread members 140 aligned in a respective transverse row are offset with the conical shaped hollow tread members 140 aligned in an adjacent transverse row.

In one of the preferred embodiments, each of the conical shaped hollow tread members is filled with silicone resin to increase its impact absorbency.

The fourth novel feature of the present invention basketball shoe is that the ball portion 134 of the outsole 130 further has two longitudinally elongated edgewise non-hollow tread members 152 and 154 each having a plurality of transverse grooves 156 and 158 respectively, where the respective transverse grooves 156 and 158 of the two edgewise non-hollow tread members 152 and 154 are aligned respectively. The two longitudinally elongated edgewise tread members 152 and 154 are made stiffer than the conical shaped hollow tread members 140 to provide a centered stability to the basketball shoe 100. When a basketball player lands on the ball portion of his forefoot, the stiffer edgewise tread member will prevent his foot from landing off center, which often causes ankle injuries such as twisting an ankle.

The present invention basketball shoe sole has many advantageous features. Its most important feature is that to a basketball player's foot, it provides (a) high impact absorbability; (b) superb stability; and (c) maximum flexibility. These features greatly reduce the intensity of the fatigue of the basketball players' feet, and reduce the risk of injuries to the basketball players' feet.

While the hollow tread members are described here as conical shaped, it will be appreciated that other suitable shapes, such as egg shape, may also be employed. In addition, while the hollow tread members are described here as provided only at the ball portion of the present invention basketball shoe sole, it will be appreciated that they may well be located at other portions, such as the heel portion. The novelty of the tread members of the present invention basketball shoe sole is that they are hollow inside for collapsibly absorbing the high impact forces exerted upon them.

Figure 9:
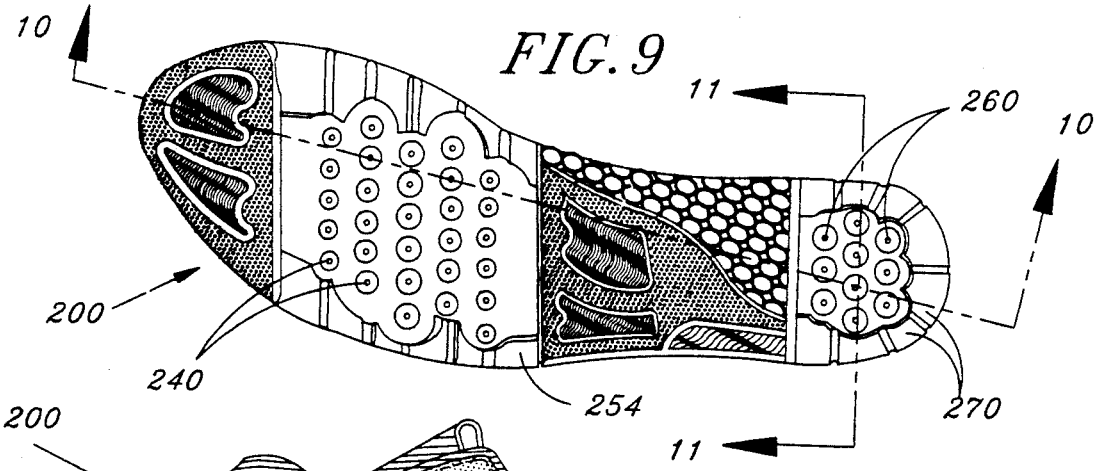
FIG. 9 is a bottom view of an athletic shoe incorporating an alternative embodiment of the present invention athletic shoe sole.
Figure 10:
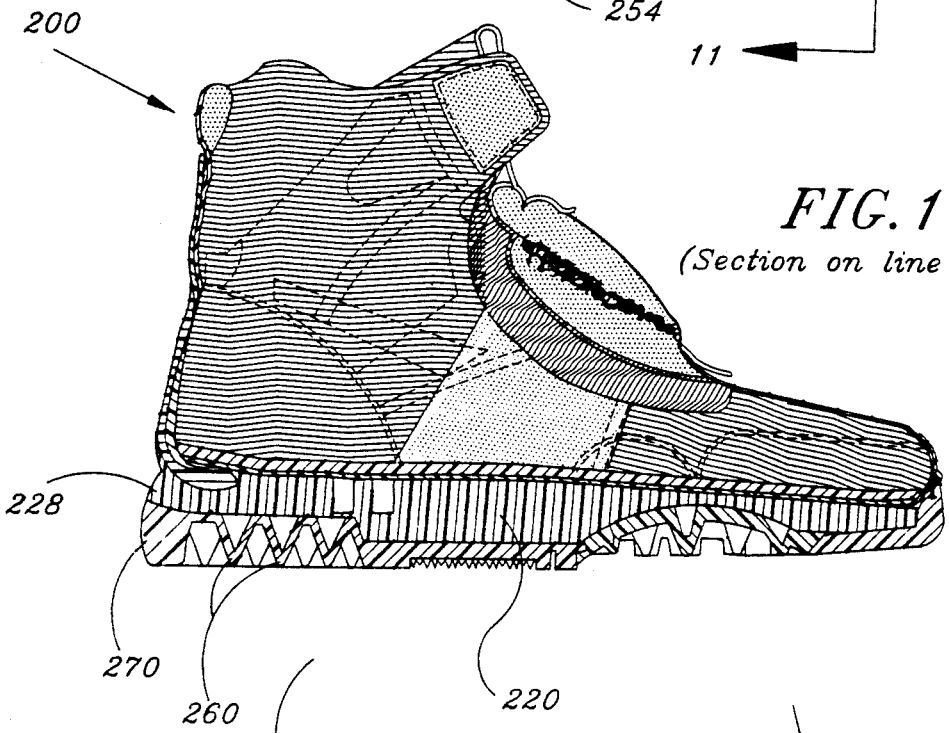
FIG. 10 is a longitudinal cross-sectional view of an athletic shoe incorporating the alternative embodiment of the present invention athletic shoe sole taken along line 10—10 of FIG. 9.
Figure 11:
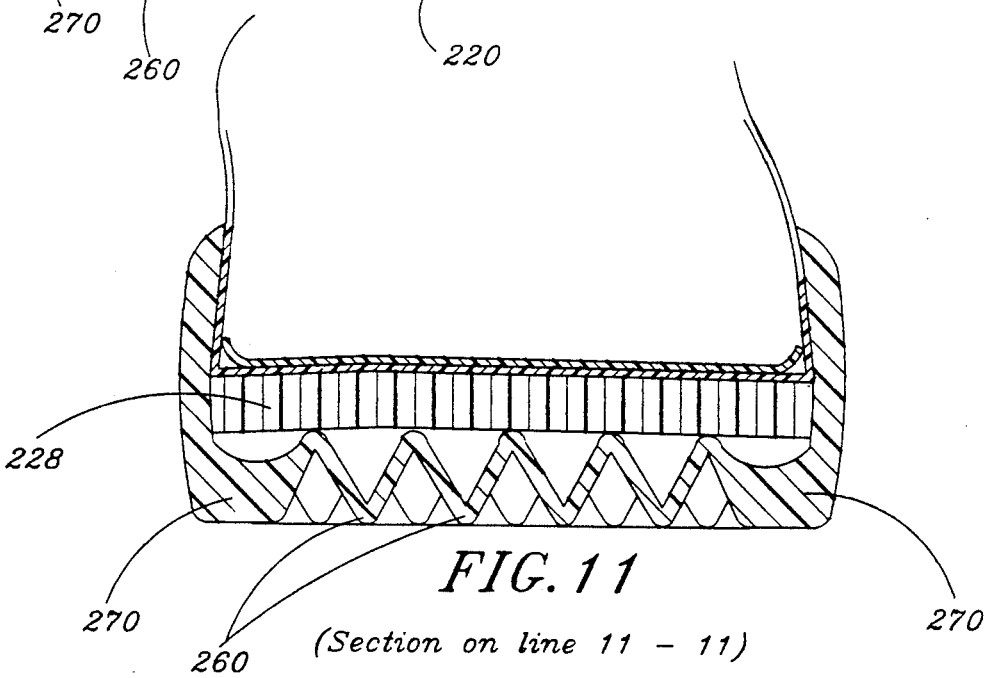
FIG. 11 is a transverse cross-sectional view of an athletic shoe incorporating the alternative embodiment of the present invention basketball shoe sole taken along line 11—11 of FIG. 9.

Referring to FIGS. 9, 10 and 11, there is shown a bottom view of a basketball shoe 200 where not only the ball portion but also the heel portion of the basketball shoe sole has hollow tread members. The heel portion 228 of the midsole 220 is thinner than that of a conventional basketball shoe midsole, and the space left is filled with the hollow tread members. The most important purpose of the hollow tread members is to make the edgewise tread members stiffer than the central tread members, so the wearer's foot is properly balanced back to the center when landing on the edges. There are several important features of the hollow tread members disclosed here which are designed to ensure this concept, and they are also applicable to other portions of the basketball shoe sole.

Figure 12:
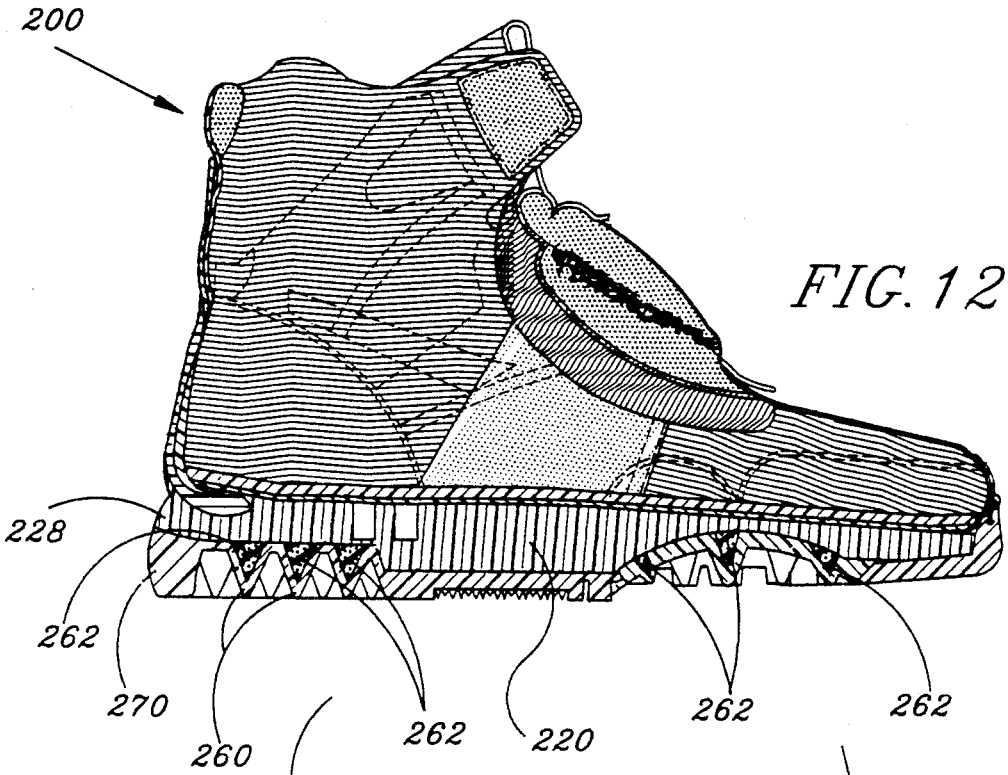
FIG. 12 is a longitudinal cross-sectional view of an athletic shoe incorporating the alternative embodiment of the present invention athletic shoe sole, showing that the edgewise tread members 270 have shallow recesses filled with hard resilient material 272, and the centrally located conical shaped tread members 260 have deep recesses filled with soft material 262.
Figure 13:
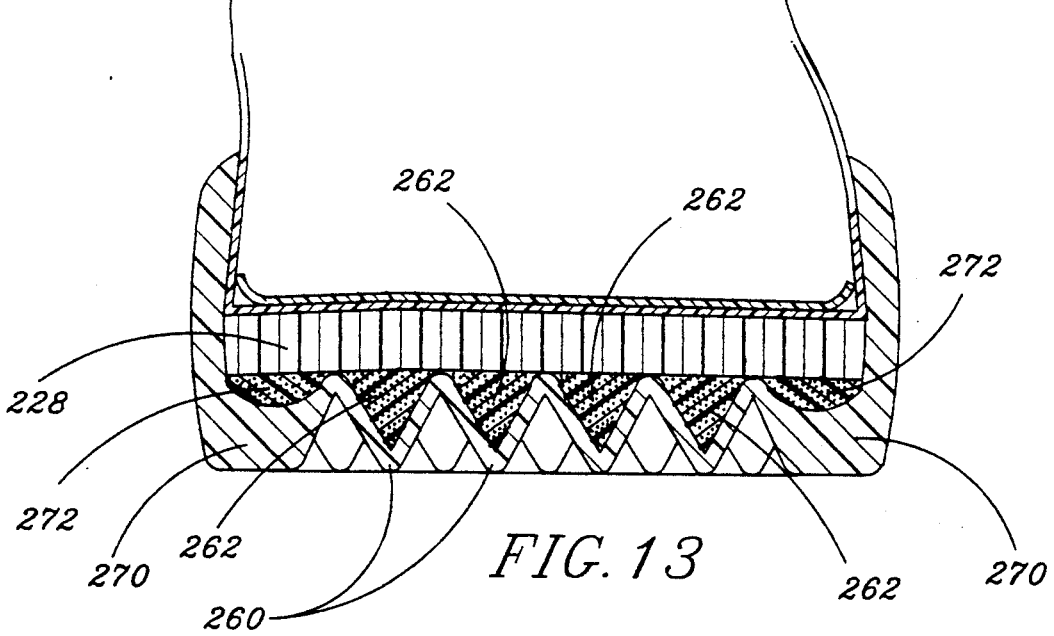
FIG. 13 is a transverse cross-sectional view of an athletic shoe incorporating the alternative embodiment of the present invention basketball shoe sole, also showing that the edgewise tread members 270 have shallow recesses filled with hard resilient material 272, and the centrally located conical shaped tread members 260 have deep recesses filled with soft material 262.

Shown in FIGS. 9, 10 and 11 is a multiplicity of centrally located conical shaped hollow tread members 260 aligned in a plurality of transverse lines, and a multiplicity of edgewise located tread members 270 positioned along a "U"-shaped curve. The first design feature is that the central tread members 260 are more conical shaped, whereas the edgewise tread members 270 are more rectangular shaped. This makes the central tread members 260 easier to collapse than the edgewise tread members. The second design feature is that the edgewise tread members may also be hollow tread members, but the hollow chambers of the edgewise hollow tread members 270 are much shallower than these of the central hollow tread members 260. In other words, the walls of the central hollow tread members 260 are much thinner than those of the edgewise hollow tread members 270. The third design feature is that the material used in making the edgewise tread members 270 is much harder or denser than that used in making the central tread members 260. The fourth design feature is shown in FIGS. 12 and 13 and illustrates that both the central tread members 260 and the edgewise tread members 270 may be filled with soft resilient materials such as silicone, where the resilient filling 272 for the edgewise tread members 270 may be harder or denser than the resilient filing 262 for the central tread members 260.

The purpose of these design features is to ensure that while the hollow tread members provide adequate shock absorbance to the wearer's foot, the stiffer edgewise tread members return the wearer's foot to its balanced center position to avoid ankle injuries. When a wearer's foot lands on the ground unbalanced, the edgewise tread members will first contact the ground and then the central tread members. Since the edgewise tread members are much stiffer than the central tread members, the wearer's foot is quickly balanced back to its centralized position. It will be appreciated that these above disclosed features are applicable to any portions of the basketball shoe sole including the ball portion and the heel portion.

Defined in detail, the present invention is a basketball shoe sole comprising: (a) a midsole having a longitudinally concave shaped ball portion which is thinnest along a transverse metatarsal line, such that a longitudinal concavity is formed facing downwardly and crossing the entire width of the ball portion of the midsole; (b) an outsole having a longitudinally convex shaped ball portion which is thickest along the transverse metatarsal line, such that a longitudinal convexity is formed facing upwardly and crossing the entire width of the ball portion of the outsole; (c) said longitudinally convex shaped ball portion of said outsole having a multiplicity of conical shaped hollow tread members aligned in a plurality of transverse rows; and (d) said longitudinally convex shaped ball portion of said outsole further having two longitudinally elongated edgewise non-hollow tread members each having a plurality of transverse grooves.

In one of the preferred embodiments of the present invention defined in detail: (a) the vertical dimensions of the multiplicity of conical shaped hollow tread members are different, such that the outsole has a generally flat bottom surface; (b) the vertical dimensions of the respective ones of the multiplicity of conical shaped hollow tread members aligned in a respective one of the plurality of transverse rows are the same; (c) the respective ones of the multiplicity of conical shaped hollow tread members aligned in a respective one of the plurality of transverse rows are offset with the other respective ones of the multiplicity of conical shaped hollow tread members aligned in an adjacent one of the plurality of transverse rows; (d) the respective ones of the plurality of transverse grooves of one of the two longitudinally elongated edgewise non-hollow tread members are aligned with the other respective ones of the plurality of transverse grooves of the other one of the two longitudinally elongated edgewise non-hollow tread members; (e) each of the multiplicity of conical shaped hollow tread members is filled by silicone resin.

Defined broadly, the present invention is an athletic shoe sole comprising: (a) a midsole having a longitudinally concave shaped forefoot portion which is thinnest along a transverse line, such that a longitudinal concavity is formed facing downwardly and crossing the entire width of the forefoot portion of the midsole; (b) an outsole having a longitudinally convex shaped forefoot portion which is thickest along the transverse line, such that a longitudinal convexity is formed facing upwardly and crossing the entire width of the forefoot portion of the outsole; and (c) said longitudinally convex shaped forefoot portion of said outsole having a multiplicity of conical shaped hollow tread members aligned in a plurality of transverse rows.

Defined more broadly, the present invention is a shoe sole comprising: (a) a midsole having a concave shaped forefoot portion, such that a concavity is formed crossing the entire width of the forefoot portion of the midsole; (b) an outsole having a convex shaped forefoot portion, such that a convexity is formed crossing the entire width of the forefoot portion of the outsole; and (c) said convex shaped forefoot portion of said outsole having a multiplicity of hollow tread members.

Alternatively defined in detail, the present invention is a basketball shoe sole comprising a midsole and an outsole, the midsole having a longitudinally concave shaped ball portion which is thinnest along a transverse line, such that a longitudinal concavity is formed facing downwardly and crossing the entire width of the ball portion of the midsole.

Alternatively defined broadly, the present invention is a shoe sole comprising a midsole and an outsole, the midsole having a concave shaped forefoot portion, such that a concavity is formed crossing the entire width of the forefoot portion of the midsole.

Also alternatively defined in detail, the present invention is a basketball shoe sole comprising a multiplicity of conical shaped hollow tread members aligned in a plurality of transverse rows, and two longitudinally elongated edgewise non-hollow tread members each having a plurality of transverse grooves.

Also alternatively defined broadly, the present invention is a shoe sole comprising a multiplicity of hollow tread members.

Again defined alternatively in detail, the present invention is an athletic shoe outsole comprising at its heel portion: (a) a multiplicity of centrally located conical shaped tread members having deep hollow chambers and aligned in a plurality of transverse rows; and (b) a multiplicity of edgewise tread members having shallow hollow chambers and positioned along a "U"-shaped curve.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. An athletic shoe sole comprising:
   a. a midsole having a longitudinally concave shaped forefoot portion which is thinnest along a transverse line, such that a longitudinal concavity is formed facing downwardly and crossing the entire width of the forefoot portion of the midsole;
   b. an outsole having a longitudinally convex shaped forefoot portion which has two longitudinally elongated edgewise non-hollow tread members and is thickest along the transverse line, such that a longitudinal convexity is formed facing upwardly and crossing the entire width between said two edgewise tread members of the forefoot portion of the outsole; and
   c. said longitudinally convex shaped forefoot portion of said outsole having a multiplicity of conical shaped hollow tread members aligned in a plurality of transverse rows, wherein the vertical dimensions of the multiplicity of conical shaped hollow tread members are different, such that said outsole has a generally flat bottom surface.

2. The invention as defined in claim 1 wherein said forefoot portions of said midsole and said outsole are aligned with the ball portion of a wearer's foot.

3. The invention as defined in claim 1 wherein said transverse line is aligned with the metatarsal line of a wearer's foot.

4. The invention as defined in claim 1 wherein the vertical dimensions of the respective ones of said multiplicity of conical shaped hollow tread members aligned in a respective one of said plurality of transverse rows are the same.

5. The invention as defined in claim 1 wherein the respective ones of said multiplicity of conical shaped hollow tread members aligned in a respective one of said plurality of transverse rows are offset with the other respective ones of said multiplicity of conical shaped hollow tread members aligned in an adjacent one of said plurality of transverse rows.

6. The invention as defined in claim 1 wherein said two longitudinally elongated edgewise non-hollow tread members each has a plurality of transverse grooves.

7. An athletic shoe sole comprising:
   a. a midsole having a longitudinally concave shaped forefoot portion which is thinnest along a transverse line, such that a longitudinal concavity is formed facing downwardly and crossing the entire width of the forefoot portion of the midsole;
   b. an outsole having a longitudinally convex shaped forefoot portion which has two longitudinally elongated edgewise tread members and is thickest along the transverse line, such that a longitudinal convexity is formed facing upwardly and crossing the entire width between said two edgewise tread members of the forefoot portion of the outsole;
   c. said longitudinally convex shaped forefoot portion of said outsole having a multiplicity of conical shaped tread members aligned in a plurality of transverse rows, wherein the vertical dimensions of the multiplicity of conical shaped tread members are different, such that said outsole has a generally flat bottom surface; and
   d. each of said multiplicity of conical shaped tread members having a recess which is filled by a soft resilient material.

8. A basketball shoe sole comprising:
   a. a midsole having a longitudinally concave shaped ball portion which is thinnest along a transverse metatarsal line, such that a longitudinal concavity is formed facing downwardly and crossing the entire width of the ball portion of the midsole;
   b. an outsole having a longitudinally convex shaped ball portion which has two longitudinally elongated edgewise non-hollow tread members each having a plurality of transverse grooves and is thickest along the transverse metatarsal line, such that a longitudinal convexity is formed facing upwardly and crossing the entire width between the two edgewise tread members of the ball portion of the outsole; and c. said longitudinally convex shaped ball portion of said outsole having a multiplicity of conical shaped hollow tread members aligned in a plurality of transverse rows, wherein the vertical dimensions of the multiplicity of conical shaped hollow tread members are different, such that said outsole has a generally flat bottom surface.

9. The invention as defined in claim 8 wherein the vertical dimensions of the respective ones of said multiplicity of conical shaped hollow tread members aligned in a respective one of said plurality of transverse rows are the same.

10. The invention as defined in claim 9 wherein the respective ones of said multiplicity of conical shaped hollow tread members aligned in a respective one of said plurality of transverse rows are offset with the other respective ones of said multiplicity of conical shaped hollow tread members aligned in an adjacent one of said plurality of transverse rows.

11. The invention as defined in claim 9 wherein the respective ones of said plurality of transverse grooves of one of said two longitudinally elongated edgewise non-hollow tread members are aligned with the other respective ones of said plurality of transverse grooves of the other one of said two longitudinally elongated edgewise non-hollow tread members.

12. A basketball shoe sole comprising:

a. a midsole having a longitudinally concave shaped ball portion which is thinnest along a transverse metatarsal line, such that a longitudinal concavity is formed facing downwardly and crossing the entire width of the ball portion of the midsole;

b. an outsole having a longitudinally convex shaped ball portion which has two longitudinally elongated edgewise tread members each having a plurality of transverse grooves and is thickest along the transverse metatarsal line, such that a longitudinal convexity is formed facing upwardly and crossing the entire width between the two edgewise tread members of the ball portion of the outsole;

c. said longitudinally convex shaped ball portion of said outsole having a multiplicity of conical shaped tread members aligned in a plurality of transverse rows, wherein the vertical dimensions of the multiplicity of conical shaped tread members are different, such that said outsole has a generally flat bottom surface; and d. each of said multiplicity of conical shaped tread members having a recess which is filled with silicone resin.

13. A shoe sole comprising:

a. a midsole having a concave shaped forefoot portion, such that a concavity is formed facing downwardly and crossing the entire width of the forefoot portion of the midsole;

b. an outsole having a convex shaped forefoot portion with two opposite narrow side portions, such that a convexity is formed facing upwardly and crossing the entire width between the two side portions of the forefoot portion of the outsole; and c. said convex shaped forefoot portion of said outsole having a multiplicity of hollow tread members, wherein the vertical dimensions of the multiplicity of hollow tread members are different, such that said outsole has a generally flat bottom surface.

14. The invention as defined in claim 13 wherein said concave shaped forefoot portion of said midsole is thinnest along a generally transverse line, and said convex shaped forefoot portion of said outsole is thickest along the generally transverse line.

15. The invention as defined in claim 13 wherein said multiplicity of hollow tread members are conical shaped.

16. A basketball shoe outsole comprising an upward facing convex shaped forefoot portion which has a multiplicity of conical shaped hollow tread members aligned in a plurality of transverse rows, and two longitudinally elongated edgewise non-hollow tread members each having a plurality of transverse grooves, wherein the vertical dimensions of the multiplicity of conical shaped hollow tread members are different, such that the outsole has a generally flat bottom surface.

17. A basketball shoe outsole comprising an upward facing convex shaped forefoot portion which has a multiplicity of conical shaped tread members aligned in a plurality of transverse rows, and two longitudinally elongated edgewise tread members each having a plurality of transverse grooves, wherein the vertical dimensions of the multiplicity of conical shaped tread members are different, such that the outsole has a generally flat bottom surface, and each of said multiplicity of conical shaped tread members has a recess which is filled with silicone resin.

18. An athletic shoe outsole comprising at its heel portion:

a. a multiplicity of centrally located conical shaped tread members having deep recesses and aligned in a plurality of transverse rows;

b. a multiplicity of edgewise located tread members having shallow recesses and positioned along a "U"-shaped curve; and c. said deep recesses of said multiplicity of centrally located conical shaped tread members being filled with softer material, and said shallow recesses of said multiplicity of edgewise located tread members being filled with harder material.

19. The invention as defined in claim 18 wherein said multiplicity of centrally located conical shaped tread members are made of softer material, and said multiplicity of edgewise located tread members are made of harder material.

* * * * *